United States Patent [19]

Bernard

[11] Patent Number: 4,887,558

[45] Date of Patent: Dec. 19, 1989

[54] INTERNAL-COMBUSTION ENGINE HAVING OPPOSED INTEGRAL ANNULAR PISTONS AND A CENTRAL SHAFT

[75] Inventor: Esparbes Bernard, Hautes-Pyrénées, France

[73] Assignee: Aerospatiale Societe Nationale Industrielle, Societe Anonyme, Paris Cedex, France

[21] Appl. No.: 159,266

[22] Filed: Feb. 23, 1988

[51] Int. Cl.[4] ..... F02B 75/26

[52] U.S. Cl. ..... 123/58 C; 123/52 B; 123/62; 123/70 R

[58] Field of Search ..... 123/61 R, 62, 58 R, 123/58 C, 58 A, 58 AA, 52 B, 56 C, 47 R, 70 R, 71 R

[56] References Cited

U.S. PATENT DOCUMENTS

| | | | |
|---|---|---|---|
| 1,197,591 | 9/1916 | Bargery | 123/58 C |
| 1,613,136 | 1/1927 | Schieffelin | 123/58 C |
| 1,745,821 | 2/1930 | Gribojedoff | 123/58 C |
| 3,943,859 | 3/1976 | Howell | 123/58 AA |
| 4,090,478 | 5/1978 | Trimble et al. | 123/58 R |
| 4,453,504 | 6/1984 | Freeman et al. | 123/52 B |

FOREIGN PATENT DOCUMENTS 501342 7/1930 Fed. Rep. of Germany .... 123/58 C

*Primary Examiner*—Craig R. Feinberg
*Attorney, Agent, or Firm*—Bierman and Muserlian

[57] ABSTRACT

The invention relates to an internal-combustion engine having opposed integral annular pistons and a central shaft. The piston block (1), formed by the two pistons (2, 3) exhibits, at each axial end, an axial double skirt fitted with an outer crown (9) forming the piston head proper, and an inner crown (10) forming an admission pump with an antechamber (30) radially within the corresponding annular cylinder (5), wherein the piston head (9) delimits a combustion chamber (12). Radial pawls (22), penetrating axial ports (21) of the housing (4) and radial holes (18) of the piston block (1), have their inner radial ends engaged in sinusoidal circumferential undulated grooves (20) made in an enlarged central part (19) of the central driving shaft (8) driven in rotation by the reciprocating axial movements of the piston block (1). The admission of comburent gas and/or fuel is effected axially by the ends, through valves (29) and orifices (28) in end plates (6) closing the antechambers (30) in which slide the inner crowns (10, 10a) fitted with flaps (11) to function as an admission pump. Application to an internal-combustion engine, of this type is for use to particularly equip aircraft.

11 Claims, 4 Drawing Sheets

INTERNAL-COMBUSTION ENGINE HAVING OPPOSED INTEGRAL ANNULAR PISTONS AND A CENTRAL SHAFT

This invention relates to internal-combustion engines having opposed integral annular pistons and having a central driving shaft, said engines using fuels such as gas-oil, kerosene, petrol, etc. . . and possibly comprising two, four, six, eight or more cylinders.

Engines of the internal-combustion type, equipped with conventional pistons, which are distributed commercially, currently consume a great deal of energy in order to deliver a low useful power. This relatively poor efficiency is due mainly to the design of the moving members constituted by the pistons, the connecting rods, the crankshaft and the valves. These conventional engines are moreover weakened by the large number of moving parts which they comprise and which are subjected to permanent and substantial forces.

With the aim of overcoming these disadvantages, an internal-combustion engine operating with a better energy efficiency and of considerably simplified construction has already been proposed by British Pat. No. 11,027.

The advantage of the engine proposed in this British Patent lies in the elimination of the connecting rods and of the crankshaft, which also makes it possible to produce an engine, the rotational speed of which is adapted to its use, without impairing its efficiency.

In the internal-combustion engine according to British Pat. No. 11,027, two annular cylinders are arranged each on one side of an undulated central member, being open towards each other, and two annular pistons, fitted opposed and each on one side of the undulated central member, are fitted so that the head of each of the annular pistons slides fluidtightly in one of the annular cylinders. Thus, the reciprocating movement of the pistons is converted into a rotary movement of the central driving shaft, which penetrates the annular cylinders and pistons coaxially, through the intermediary of the undulated central member, which is integral with the central shaft.

The annular pistons each cooperate with the undulated central member extending substantially radially between them, relative to the axis of rotation of the central shaft, so that the pistons move away from each other simultaneously or approach each other simultaneously. The undulated central member is a radial plate having an undulated edge, each of the opposite faces of which receives the thrust of one of the pistons, through the intermediary of axial pawls, interposed between the base of each annular piston and the opposite face of the undulated radial disk, the axial pawls associated with one of the pistons occupying positions staggered in the circumferential direction relative to the axial pawls associated with the other piston. Moreover, these pistons exhibit radial inward projections which penetrate into a groove made in the external circumference of the plate, with the object of maintaining the pistons in contact with the plate at all times, whereas the thrust of the pistons is applied to the plate by the pawls. These axial pawls are retained by radial pins which are continued outwards by projections penetrating into longitudinal grooves made in the housing mutually connecting the two annular cylinders, so that the pistons are guided in reciprocating axial movement in the cylinders which are fixed in rotation, if the central shaft is a rotary driving shaft.

If the engine has controlled ignition, the combustible mixture is fed through the hollow driving shaft, through the intermediary of a cylindrical dome, integral with the cylinders and housed in the hollow shaft, so that the combustible mixture first reaches the chamber delimited between the two annular pistons and then passes into the annular combustion chambers, between the piston heads and the base of the annular cylinders, when the annular pistons move towards each other, in a four-stroke cycle as in a two-stroke cycle, the passage of the combustible mixture being provided through axial ducts which extend for a certain axial distance in the interior face of the interior radial wall of the annular cylinders, and opening into the combustion chambers opposite a curved part of the corresponding annular piston head. The exhaust of the burnt gases is effected through exhaust orifices provided in the exterior radial wall of each annular cylinder. When the pistons are repelled towards each other by the explosion of the combustible mixture in the combustion chambers, the corresponding axial pawls transmit this thrust to the undulations of the central disk, and are therefore compelled to move against the inclined parts of the undulations, which causes the rotation of the undulated disk, and hence of the shaft, whereas the mutual separation of the two pistons results from the rotation of this undulated disk, the inclined parts of which compel the axial pawls to repel the pistons towards the bases of the corresponding combustion chambers, by the effect of inertia of rotation acquired by the undulated disk and shaft.

In variant embodiments, the base of each of the annular pistons exhibits an undulated profile, which corresponds to the undulations of the central disk, and which comes into contact with these undulations through the intermediary of bearing members such as balls. In this case, the projections of the undulations of one piston correspond to the cavities of the undulations of the opposite piston, in order to obtain simultaneous separation or simultaneous approach movements of both pistons.

In another variant, the pistons also have their base undulated, but the undulated central disk is replaced by a cruciform member, integral with the shaft, and carrying pairs of rollers positioned so that they come into contact with the undulated edges of the two pistons which, in this case, exhibit perfectly corresponding undulations, that is to say the projections of the undulations of one piston face the projections of the undulations of the opposite piston, so that the pistons move away from or approach each other simultaneously, as in all the other cases described in this British Patent.

The ignition is provided by plugs fitted in the bases of the cylinders, and both the number and the shape of the undulations will depend upon the type of engine and the required speed of rotation.

Improvements to this engine have been proposed in U.S. Pat. No. 4,090,478, which describes a multicylinder and sinusoidal engine. This engine comprises a housing constituted by the assembly of two frustums of cylinders, and which exhibits a central cylindrical bore for the passage of a hollow shaft exhibiting, in its external lateral surface, two pairs of undulated grooves, staggered axially and with sinusoidal undulations, the central bore, being surrounded by a plurality of cylindrical bores, regularly distributed in the circumferential direction about the central cylindrical bore and with axes parallel to that of the latter. Two independent pistons are housed in each circumferential cylindrical bore, the piston heads of which face each other so as to delimit between them a single combustion chamber for each circumferential cylinder, and each of the pistons is connected by a coupling mechanism to a pair of sinusoidal grooves, for the conversion of the reciprocating axial movement of the pistons into a rotational movement of the central hollow shaft. In this engine, the two independent pistons housed in each circumferential circular cylindrical bore are pistons which approach or move away from each other simultaneously, and the admission of the combustible mixture into the combustion chamber delimited between the two pistons, as well as the exhaust of the combustion gases from this combustion chamber, are effected axially in the hollow shaft, then, radially, by a complex system of valves and flaps. Likewise, the ignition is effected partially through the interior of the hollow central shaft, and by means of a complex mechanism. The coupling mechanism of each of the pistons to a pair of sinusoidal grooves of the hollow central shaft comprises two parallelepipedic push-rods housed in radial passages of corresponding shape in the pistons and mutually spaced radially by springs, so that the one is applied against the exterior lateral surface of the hollow shaft through the intermediary of balls retained in spherical segmental housings recessed in the interior radial face of this push-rod and simultaneously engaged in the sinusoidal grooves of the shaft, whereas the other push-rod, in an exterior radial position, is applied against the interior radial face of the housing through the intermediary of balls, likewise housed in spherical segmental cavities made in the exterior radial face of this push-rod and also received in longitudinal ports machined into the interior face of the housing.

As a result of this, such an engine exhibits an extremely complex structure, and its production and maintenance costs are extremely high.

An internal-combustion engine with double-acting piston fitted reciprocating in a housing with two chambers mutually separated by a fixed annular partition is also known from U.S. Pat. No. 3,786,790. In each of the two chambers an annular piston is housed surrounding a central driving shaft which penetrates the partition and, coaxially, the whole of the housing, and the two annular pistons are mutually integral by an annular sleeve likewise surrounding the central shaft and penetrating the partition. The two annular pistons thus form a monolithic piston block which slides axially and reciprocatingly in both senses in the housing. A single combustion chamber is arranged in the intermediate partition separating the two chambers in which the annular pistons slide. The combustion chamber further comprises a ball valve placing one of the two chambers of the housing alternately in communication with the combustion chamber, so that the combustion and expansion stroke of a combustible mixture causes the movement of one piston towards the corresponding base of the cylinder, and simultaneously the compression by the other piston of the combustible mixture, previously admitted into the corresponding housing chamber, towards the combustion chamber in which the valve ball is displaced to block the communication with the other chamber. In this engine likewise, the conversion of the reciprocating axial movement of the pistons into a rotational movement of the central shaft is effected by balls engaged partially in a spherical dome-shaped housing made in the interior lateral surface of the connecting sleeve of the two pistons, and also in an undulated groove of substantially sinusoidal shape, made in the circumference of the central shaft.

The disadvantage of such an engine lies essentially in the extreme stresses undergone by the ball valve fitted in the single combustion chamber made in the intermediate wall, and also in the construction of this combustion chamber and of the associated ball valve.

The object of the present invention is to improve the internal-combustion engines known from British Pat. No. GB 11,027, without using such a complex and expensive structure as that of the engines according to U.S. Pat. No. 4,090,478, but with greater reliability and efficiency than those of the engines according to U.S. Pat. No. 3,486,790, which can only function in combination with relatively complex admission and exhaust systems comprising a large number of valves.

To this end, the internal-combustion engine according to the invention, which may be a controlled ignition engine, of the two or four-stroke petrol type, or again a diesel engine, operating with a feed pump or a turbocompressor, a carburetter or an injection pump, and capable of being combined with a gearbox, a clutch and, optionally, with a dynamo, a battery, etc. . . is an engine of the type known from British Pat. No. GB 11,027 and comprising at least one driving shaft, driven in rotation by at least one engine assembly which the shaft penetrates coaxially, and which comprises a cylindrical housing, each axial end of which is integral with one of the two hollow and annular cylinders, open towards each other and each closed by a base on the opposite side, and two annular pistons guided in axial translation in the housing, in which they are fitted opposed, so that each of them exhibits a piston head engaged to slide fluid tightly in axial reciprocation each in one of the two annular cylinders, in each of which an annular combustion chamber is delimited between the corresponding cylinder end and the piston head. Each combustion chamber is supplied by an admission system for a comburent gas and/or a fuel and is in communication, through the exterior radial wall of the corresponding annular cylinder, with a combustion gas exhaust system. The two pistons, the housing, the two cylinders and the shaft are fitted coaxially about the longitudinal axis of the shaft and the reciprocating axial movements of the pistons are converted into rotation of the shaft about its axis by a movement conversion mechanism coupling the pistons to a central part of the shaft, and comprising pawls, one end of each of which is compelled to follow endless undulations, circumferential about the axis of the shaft and of the same axial amplitude, which are exhibited by a rigid member.

According to the invention, the internal-combustion engine of this type is characterized in that the two pistons are mutually integral by their bases and form a monolithic piston-block, a central element of which slides in the housing so that the two pistons move simultaneously in the axial direction and alternately in each sense, and the pawls, of the movement conversion mechanism are radial pawls, retained in one of the two rigid members formed by the central part of the shaft and by the central element of the piston-block, whereas the undulations are defined by at least one groove made in an axial surface of the other rigid member, and in which, or in each of which, one end of each radial pawl is engaged.

According to alternative embodiments of the engine according to the invention, the driving shaft may penetrate a single engine assembly and be actuated by the latter, or again the driving shaft may penetrate a plurality of engine assemblies and be actuated by one or a plurality of the latter, which permits one or a plurality of engine assemblies to be left at rest.

Moreover, in each engine assembly, the spacing of the annular cylinders is obviously determined by the axial length of the common housing separating them, so that when one annular piston is at its top dead center (TDC), the other annular piston is at its bottom dead center (BDC) in the other annular cylinder.

Lastly, when the forces transmitted between the pistons and the central shaft necessitate their distribution to a plurality of undulated grooves simultaneously, the undulations of these grooves are necessarily in phase.

In an advantageously simple and reliable embodiment of the movement conversion mechanism, the central part of the shaft is an enlarged cylindrical part, of greater diameter than the adjacent axial parts of the shaft which are housed in the engine assembly, and in the lateral cylindrical surface of which each undulated groove is made in which move the inner radial ends of the pawls radially penetrating the central element exhibited by the piston block and which is tubular and slides axially about the enlarged central part of the shaft, each groove in this central part forming regular undulations, the number of which is a function of the required speed of rotation of the shaft.

In order to ensure a good circumferential distribution of the forces, simultaneously to the different undulations of a groove of the shaft, and from the undulations of one groove to the undulations of the other groove or grooves of the shaft, according to the invention the central element of the annular piston block is, advantageously, penetrated in its median part by radial pawl guide holes, these holes being grouped in at least two identical sets of at least two holes each, the different sets of holes being mutually equidistant in the circumferential direction about the axis of the shaft, and the holes of each set being mutually parallel and staggered axially in one and the same radial plane, whereas the enlarged central part of the shaft exhibits grooves undulated in phase, in equal number to the number of holes per set of holes, and axially staggered correspondingly the axial staggering of the holes of each set of holes.

Further advantageously, the radial pawls of the movement conversion device are used simultaneously to effect the axial guidance of the piston-block in the assembly constituted by the housing and the two annular cylinders. For this purpose, according to the invention, the housing exhibits axial ports, leading into its cylindrical bore, and each placed radially opposite a set of holes of the piston block, the radial pawls housed in the holes of this set each having its exterior radial end engaged in the corresponding port, which thus guides them axially with the piston block in the housing.

In order to ensure good cooperation of the radial pawls with the corresponding grooves of the shaft, the inner radial end of each of the pawls penetrating one and the same set of holes provided in the piston block is kept engaged in an undulated groove of the central part of the shaft by a cage, fixed on the exterior face of the housing, about the corresponding port, and equipped with bearings ensuring good circulation of the outer radial ends of said pawls in said corresponding port. That part of each pawl which penetrates the piston block is also advantageously fitted in the corresponding hole made in the piston block through the intermediary of at least one needle bearing.

It is furthermore advantageous for each radial pawl guided in a radial hole and in a port which penetrates the piston block and the housing respectively, to be divided, substantially at mid-length, into two parts arranged end to end and such that the inner radial end of the inner radial part of the pawl and the outer radial end of the outer radial part of the pawl are engaged and can rotate mutually independently, and optionally in opposite senses, in the corresponding groove of the shaft and in the corresponding port of the housing respectively.

In the best embodiment known to date, the enlarged central part of the shaft exhibits two undulated grooves and the central element of the piston block is provided with four sets of two radial holes each, to house eight pawls guided axially in four longitudinal ports of the housing, which are closed towards the outside by four cages.

In order to improve the axial guidance of the piston-block in the housing and in the annular cylinders, the piston block advantageously comprises, at each of its axial ends, an axial double skirt comprising two annular crowns coaxial about the axis of the shaft and mutually spaced radially, and one of which, in the outer radial position, forms the head of the annular piston proper, sliding in an annular cylinder and comprising outer and inner radial segments sliding against the outer and inner walls respectively of the corresponding annular cylinder, whereas the annular crown in the inner radial position on the double skirt guides the piston block in its axial movements by sliding within the inner wall of said annular cylinder.

In this case, the inner annular crown of each double skirt of the piston block is advantageously hollow and comprises a flat and radial ring, which is spaced axially from the central element of the piston block, to which it is attached by at least one substantially axial and rigid column and which slides axially fluid-tightly in an annular antechamber, delimited between the inner wall of the corresponding annular cylinder and a coaxial sleeve, surrounding the shaft and fixed relative to the corresponding cylinder. The flat ring of each inner crown may then, according to an original characteristic of the invention, be provided with axial apertures distributed regularly over its surface and associated with valves, so that the inner crown, with the antechamber, forms an admission pump for comburent gas and/or fuel into the corresponding combustion chamber, and in which the valves are intended, on the one hand, to open the passage through the apertures into the interior of this inner crown, when the latter moves with the corresponding piston head towards the base of the corresponding cylinder, in order to admit into this hollow inner crown comburent gas and/or fuel available in the antechamber and, on the other hand, to close the apertures of the flat ring when this inner crown moves with the corresponding piston head towards the other cylinder, in order to deliver comburent gas and/or fuel into the corresponding combustion chamber, through orifices provided in the inner wall of the corresponding cylinder, preferably near the bottom dead centre of the corresponding annular piston.

In order to complement this better embodiment, in which each terminal double skirt of the piston block simultaneously constitutes the piston head proper and an admission pump for comburent gas and/or fuel into the corresponding combustion chamber, it is also advantageous for a circular plate, coaxial with the housing, with the piston block and with the cylinders, to be fixed against the base of each annular cylinder and to exhibit a central aperture fitted with a passage and rotational guide bearing for the driving shaft.

It is then advantageous for the admission system for comburent gas and/or fuel to comprise an admission pipe extending parallel to the housing and outside the latter, terminating at each of the two axial ends of the engine assembly through a substantially radial conduit which is connected to an annular tube provided with axial apertures arranged opposite axial orifices made in the plate on the corresponding side, and in which independent and compensated valves allowing the supply of the corresponding antechamber with comburent gas and/or fuel are fitted.

In order to promote the cooperation of the supply valves fitted in the axial orifices of the terminal plates of the engine assembly and of the valves associated with the axial apertures made in the flat ring of the inner crown constructed as an admission pump, and in order that the compression phase of the volume of comburent gas and/or fuel contained in the inner crown, to transfer it into the admission chamber, is simultaneous with an admission phase by suction of a fresh volume of comburent gas and/or fuel into the antechamber, it is advantageous for the longitudinal axis of each admission valve to coincide with the longitudinal axis of one of the apertures made in the flat ring of the inner crown which slides in the corresponding antechamber.

Lastly, when the engine according to the invention is of the controlled ignition type, the plates and bases of the cylinders are advantageously provided with opposite axial passages, leading into a corresponding combustion chamber, and in which sparking plugs are fitted.

Of course, in such an embodiment, the relative axial dimensions of the outer crown and of the inner crown of each double skirt are chosen so that the annular pump thus associated with each piston head effects a good supply to the corresponding annular combustion chamber, by mixing with constant movement of the quantity of combustible mixture necessary for obtaining the highest efficiency.

The invention will be better understood, and other advantages and characteristics of the invention will emerge, from the description given below, without implying a limitation, of a preferred exemplary embodiment of the engine according to the invention, described with reference to the accompanying drawings, wherein:

FIG. 2 is intended to be fitted slidingly;

Figure 5:
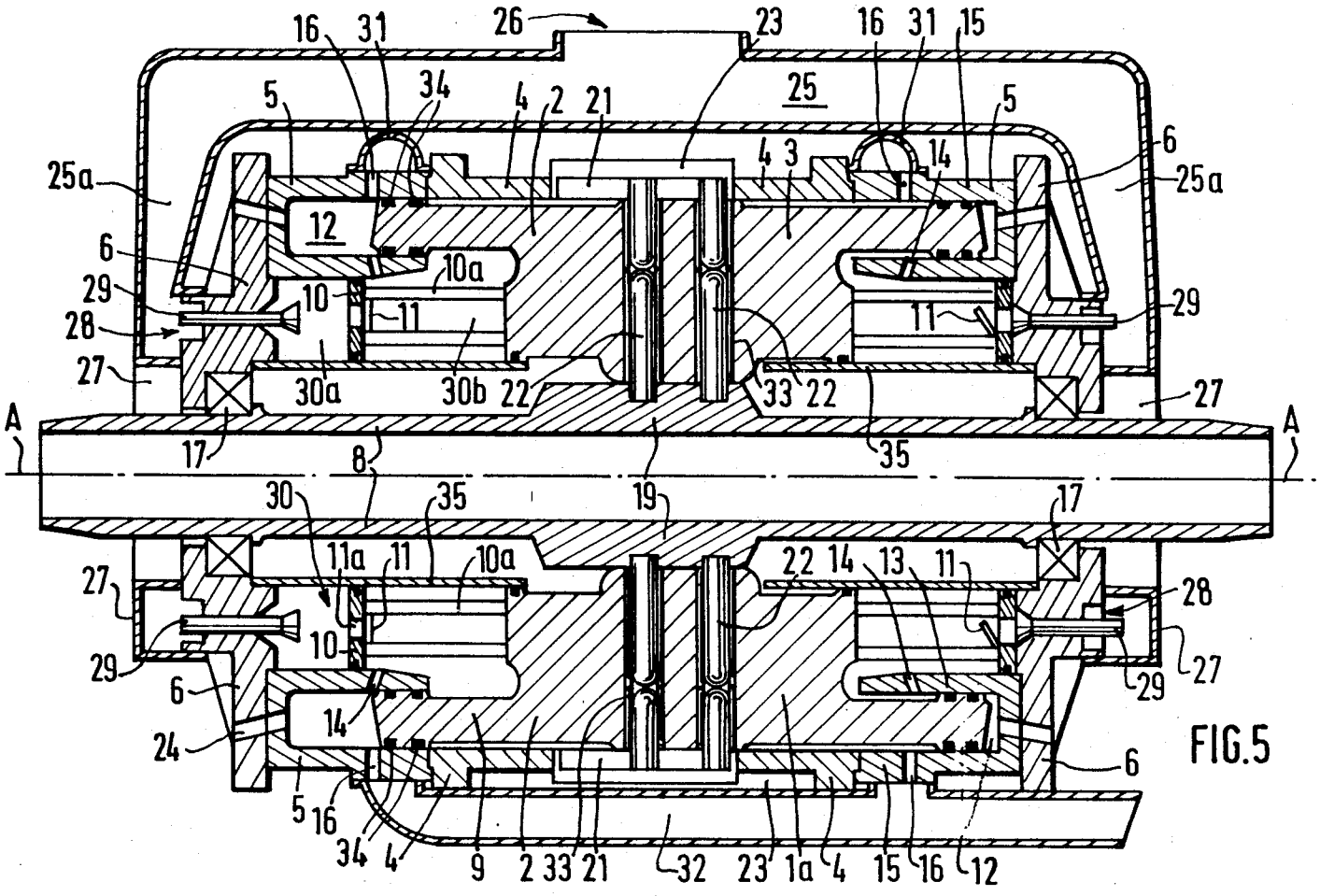
Figure 6:
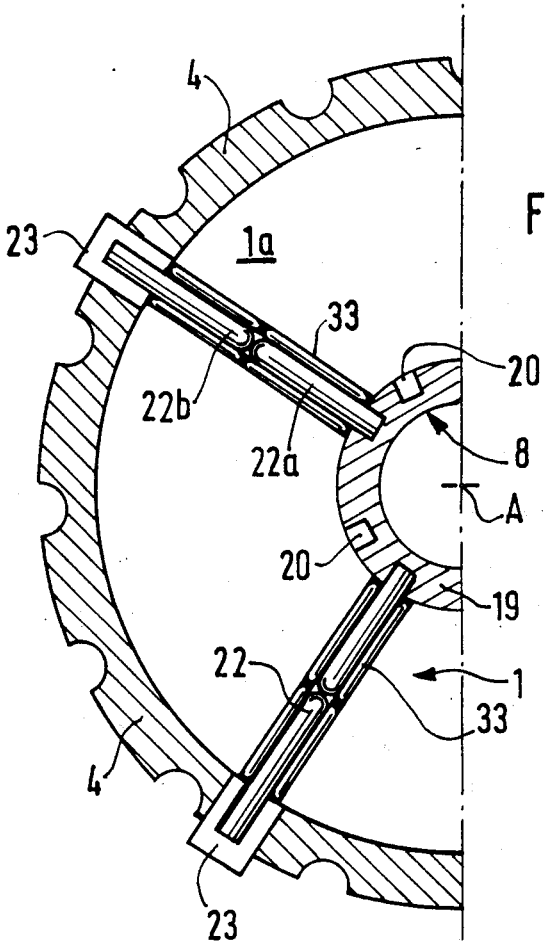

FIG. 5 shows, diagrammatically, in longitudinal and axial section, the essential parts of an engine assembly fitted coaxially about the longitudinal axis of the central driving shaft, and FIG. 6 shows, diagrammatically in half cross-section, radial pawls of a mechanism to convert the axial and reciprocating movement of the piston block into a rotational movement of the shaft, and the axial guidance of the piston block in the housing, to prevent its rotation by reaction.

Figure 1:
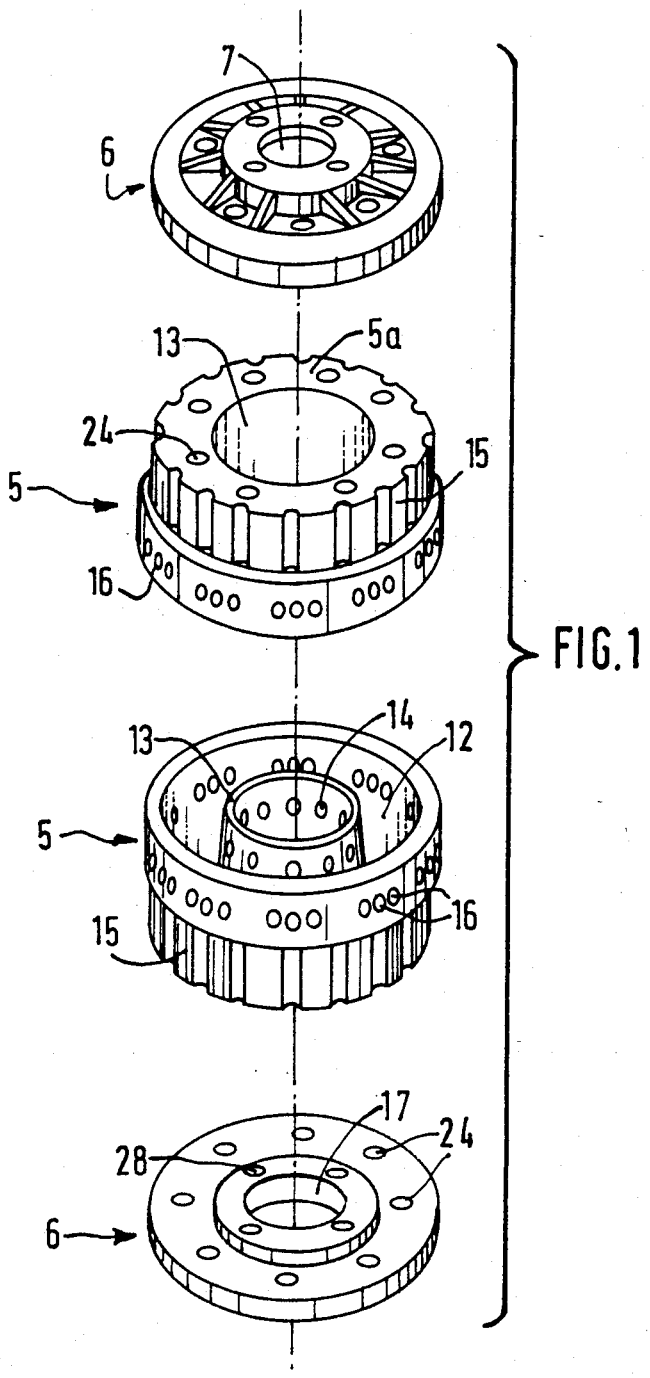
FIG. 1 shows, in perspective, a superposed assembly comprising two annular cylinders and two terminal plates, to cooperate with a pair of pistons.
Figure 2:
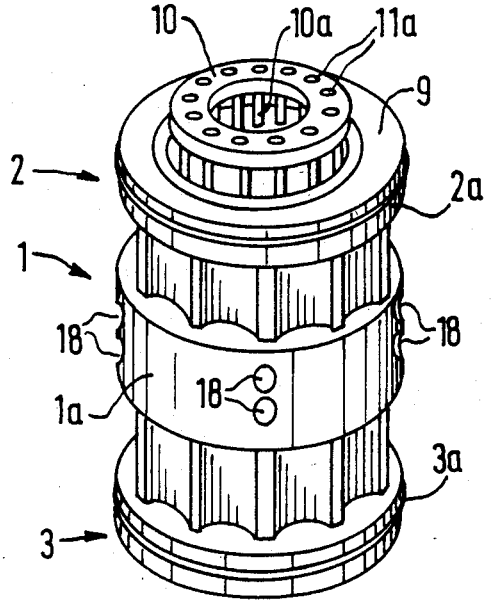
FIG. 2 shows, in perspective, two annular pistons assembled by their bases and forming a monolithic piston-block.

FIGS. 1 to 6 show an internal-combustion engine of the controlled ignition type, the combustion cycle of which is two-stroke, to simplify the description below. This engine substantially comprises a piston-block 1, consisting of two annular pistons 2 and 3 assembled opposed by their bases, of circular transverse cross-section, so that these assembled bases form a cylindrical and tubular central element 1*a* whereby the piston block 1 slides axially in the inner bore of a cylindrical housing 4, of circular cross-section, each of the axial ends of which comprises a radial fixing plate. This housing 4 is attached at each of its two axial ends to an open axial end of an annular cylinder 5, in the form of a hollow crown. Each of these annular cylinders 5 is closed at its axial end opposite that by which it is integral with the housing, by a base 5*a* against which one of the two circular plates 6 is applied, each exhibiting a central aperture 7 fitted with a bearing 17 to permit the support, the axial passage and the guidance in rotation of a driving shaft 8 or output shaft of the engine, which penetrates coaxially, about its longitudinal axis AA, the housing 4, the two cylinders 5 on each side of this housing 4, and the two end plates 6 on each side of the cylinders 5, as well as the piston block 1 formed by the assembled pistons 2 and 3. The parts of the engine assembly thus constituted about the shaft 8 are maintained stacked and clamped axially by a series of axial bolts (not shown) which connect the two plates 6. As illustrated in FIG. 2, the monolithic piston-block 1, formed by the opposed assembly of the annular pistons 2 and 3, has a cylindrical and tubular central element 1*a* which is provided in its median part, with eight radial guide holes 18, grouped in four pairs of holes which are distributed regularly in the circumferential direction about the longitudinal axis of the tubular piston block 1, that is to say which are positioned mutually at 90°, the two holes 18 of each pair being also mutually spaced axially, mutually parallel in one and the same radial plane of the piston block 1. Thus, these eight holes lead into the outer lateral surface of the tubular central element 1*a* and also into its inner lateral surface, and face one another two by two. At the axial end of the piston block 1 on the opposite side to the central element 1*a*, each annular piston 2 and 3 comprises an axial double skirt 2*a*, 3*a* comprising two coaxial annular crowns, one of which, in the outer radial position, is an outer or circumferential crown 9 which is spaced radially from the other, in the inner radial position or inner crown. This inner crown consists substantially of a flat ring 10 arranged radially and coaxially, and attached to the corresponding side of the central element 1*a* of the piston block 1 by a plurality of axial columns 10*a*, and the flat ring 10 is provided with axial orifices 11*a*, distributed regularly over its surface in the circumferential direction, with which valves 11 are associated. These valves 11 are springplate valves which are attached to that face of the flat ring 10 which faces the central element 1*a* of the piston block, and which are prestressed in the blocking position of the orifices 11*a* made in the flat ring 10 of the inner crown, so that the latter can function as an admission pumps, effecting the supply of a cylinder 5 with combustible mixture, as explained below.

The outer crown 9 of the axial double skirt 2*a* or 3*a* of the piston 2 or 3 is shaped as a piston head proper, which is engaged to slide axially fluid-tightly in both senses in one of the hollow and annular cylinders 5 (see FIGS. 2 and 5) in which an annular combustion chamber 12 is delimited between the corresponding base 5*a* of the cylinder 5 and said outer radial crown 9. The inner radial wall 13 of each cylinder 5 is provided with admission holes 14, which lead into the corresponding combustion chamber 12, when the outer radial crown 9 or piston head proper is virtually in the bottom dead center position (BDC), that is to say when it is at a maximum axial distance from the base 5*a* of the corresponding cylinder 5. Substantially at the same axial level, the outer radial wall 15 of each annular cylinder 5 is provided with holes 16 which lead out of the corresponding cylinder 5 to permit the exhaust of the combustion gases. These holes 14 and 16, which are substantially radial, and respectively delimit the admission passages and the exhaust passages to or from each annular combustion chamber 12, are distributed regularly or grouped in sets of holes distributed regularly throughout the circumference of the corresponding cylinder 5, as illustrated in FIG. 1. It will be seen in this Figure that the exhaust holes 16 are grouped in sets of three holes arranged side by side in the circumferential direction, these sets of three holes being themselves distributed regularly in this same circumferential direction.

As is illustrated clearly in FIGS. 1 and 5, the two annular cylinders 5 are fitted opposed, on either side of the housing 4, and are open towards each other, so that the outer radial crown 9 of the axial double skirt 2*a* or 3*a* of each piston 2 or 3 can move axially in the combustion chamber 12 of the corresponding cylinder 5, the two cylinders 5 being mutually separated by an interval which corresponds to the axial length of the housing 4.

Figure 4:
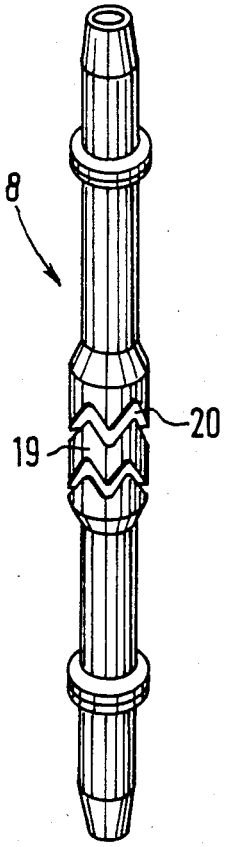
FIG. 4 shows, in perspective, a driving shaft which is housed in the engine assembly formed by the piston block, the two cylinders, the two plates and the housing.

As illustrated in FIGS. 4 and 5, the shaft 8 exhibits, at mid-length, a central part 19 which is enlarged, of cylindrical shape with circular cross-section, and with a greater diameter than the adjacent axial parts of the shaft 8. The outer lateral face of this central part 19 is provided with two grooves 20, of square cross-section, which are sinusoidal and circumferential grooves, closing on themselves, or again continuous and endless grooves, and these grooves 20 each form four regular undulations in the longitudinal sense of the shaft 8, and on its circumference, that is to say undulations of the same axial amplitude.

Figure 3:
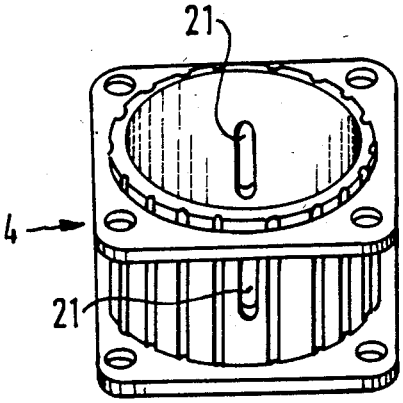
FIG. 3 shows, in perspective, a cylindrical housing intended to be attached to the assembly of the two cylinders and of the two plates of FIG. 1, and in which the piston-block

As illustrated in FIGS. 3 and 5, the housing 4 exhibits four ports 21 made radially and extending in the longitudinal direction so as to lead into the inner cylindrical bore of the housing 4. These ports 21 are distributed regularly in the circumferential direction about the longitudinal axis of the housing 4, so that they are mutually separated by an angle of 90°, so as to coincide each with one of the four pairs of guide holes 18 made radially in the tubular central element 1*a* of the piston block 1 illustrated in FIG. 2.

As illustrated in FIGS. 5 and 6, eight radial pawls 22, arranged in four pairs of two pawls, are introduced each radially into a port 21 of the housing 4 and into one of the two corresponding radial holes 18 penetrating the central element 1*a*. Each of the pawls 22 is thus housed radially through the housing 4 and the piston block 1, so that its inner radial end is housed respectively in one of the two grooves 20 undulated in phase and axially staggered along the shaft 8 with the same spacing as that which separates the two radial holes 18 of a pair of holes centered in one and the same radial plane of the central element 1*a*.

Each of the four pairs of radial pawls 22 is maintained so that the inner radial end of each of the two corresponding pawls 22 is engaged in that of two grooves 20 which occupies the corresponding axial position on the central part 19 of the shaft 8, by means of one of four identical cages 23, attached to the outer part of the housing 4, and each about one of the four ports 21, and each cage 23 contains two ballbearings (not shown) in order to improve the movement of the outer radial ends of the two pawls 22 projecting into the corresponding port 21 of the housing 4, in said port 21.

As illustrated in FIGS. 5 and 6, each of the pawls 22 is divided, substantially at mid-length, into two parts 22*a* and 22*b*, which permits the inner radial end of the inner radial part 22*a* to roll in the corresponding groove 20 of the shaft 8, and the outer radial end of the corresponding outer radial part 22*b*, to rotate and roll in the cage 23 and in the port 21 mutually independently, particularly in opposite senses.

As illustrated in FIGS. 1 and 5, each plate 6 and each cylinder 5 has an annular shape and delimits a central aperture for the passage of the driving shaft 8, and eight holes 24, equidistant in the circumferential direction, are provided in coincidence and in axial direction through the plate 6 and the base 5*a* of the adjacent cylinder, so as to lead into the annular combustion chamber 12, to receive sparking plugs which will be actuated by a common or individual ignition device, not shown.

As illustrated in FIG. 5, the supply of combustible mixture to the engine assembly is effected by a supply system comprising a supply or admission manifold pipe 25, which extends parallel to the shaft 8 but outside the housing 4, and which itself receives the combustible mixture coming from a carburettor (not shown) through a radial admission aperture 26. This admission pipe 25 is longitudinal and has its two ends connected at right angles by substantially radial conduits 25*a* to two annular terminal tubes 27 which are applied coaxially against the outer axial faces of the two plates 6. In order to permit the passage of the combustible mixture, each of the two annular tubes 27 is open on the side of the corresponding plate 6, opposite axial longitudinal orifices 28 provided through the corresponding plate 6, and distributed regularly in the circumferential direction, radially inside the sparking plug holes 24. These axial orifices 28 of the plates 6, the axes of which coincide with those of some at least of the axial passages 11*a* of the adjacent flat ring 10, serve for the axial guidance of independent valves 29, compensated by springs (not shown), each of which is housed by its stem in an orifice 28, so that the valve head is on the side of the inner axial face of the corresponding plate 6. Each valve 29 can thus be moved axially towards the central element 1*a* of the piston block 1, so that its valve head is spaced from the corresponding seat, machined in the inner axial face of the corresponding plate 6, to allow some of the combustible mixture to penetrate into an antechamber 30 which is an annular chamber delimited radially between the inner radial wall 13 of the corresponding annular cylinder 5 and an axial sleeve 35, supported coaxially around the shaft 8 by the corresponding plate 6, and extending axially substantially as far as the enlarged part 19 of the shaft 8, and so that the central element 1*a* of the piston block 1 slides fluidtightly about this sleeve 35. Moreover, the inner crown of the corresponding axial double skirt, which is formed by the flat ring 10 and its connecting columns 10*a* to the central element 1*a*, is likewise fitted to slide axially in said antechamber 30, which is subdivided into two parts, namely an upstream part 30*a*, adjacent to the plate 6 and to the corresponding valves 29, and another or downstream part 30*b*, adjacent to the central element 1*a*. These two parts 30*a* and 30*b* are mutually separated by the flat ring 10, which slides fluidtightly against, on the one hand, the inner radial wall 13 of the corresponding annular cylinder 5, and on the other hand the sleeve 35 delimiting said chamber 30.

Thus, the inner crown, formed by the flat ring 10 with its axial passages 11*a* and its valves 11, is attached by the columns 10*a* to the central element 1*a* and, with the antechamber 30, forms an admission pump for combustible mixture into the corresponding annular combustion chamber 12, functioning in the following manner: on starting, during the first axial strokes of the piston block 1 in the housing 4 and the two cylinders 5, the charge of the combustion chambers 12 is imperfect, but equilibrium is very quickly established, and the charge becomes normal. During the admission stroke, for the piston 2 for example, this piston 2 moves towards its bottom dead centre (BDC), that is to say it moves away from the end 5*a* of the cylinder 5 in which the corresponding piston head 9 slides, which causes the admission of the combustible mixture into the upstream part 30*a* of the antechamber 30. This is effected by the withdrawal of the inner crown and its flat ring 10, which, on the one hand, due to the increase in the volume of the part 30*a* of the antechamber 30, controls by suction the opening of the corresponding valves 29 and the entry into the part 30*a* of the chamber 30 of a fresh volume of combustible mixture coming from the admission pipe 25, whereas, on the other hand, since the flaps 11 remain closed in the blocking position of the orifices 11*a*, the flat ring 10 simultaneously causes the compression of the volume of combustible mixture which is in the downstream part 30*b* of the antechamber 30, which causes the transfer of this volume of combustible mixture into the corresponding annular combustion chamber 12 through the admission orifices 14. Said introduction of combustible mixture into said combustion chamber 12 drives the gases previously burnt in said chamber through the exhaust holes 16 leading into circumferential tubes 31 connected to an exhaust manifold pipe 32. During the compression stroke of the piston 2, that is to say when the piston head 9 moves in the corresponding cylinder 5 towards the base 5*a* of the latter, that is to say towards its top dead centre (TDC), the corresponding inner crown and its flat ring 10 undergo the same axial translation, which has the effect of compressing the upstream part 30*a* of the chamber 30, whereas the downstream part 30*b* is relaxed. This causes, on the one hand, the closure of the corresponding valves 29, which are applied against their respective seats on the plate 6, cutting off any entry of combustible gas coming from the admission pipe 25, and, simultaneously, the valves 11 open by bending of the spring plates which form them towards the interior of the chamber part 30*b*, due to the compression of the combustible mixture in the chamber part 30*a*, so that some combustible mixture is transferred from this upstream chamber part 30*a* towards the downstream part 30*b*. Thus, the admission pump formed by the cooperation of the flat ring 10 of [sic] the inner crown of the axial double skirt of each piston 2 or 3, with the corresponding antechamber 30, functions as a suction pump for combustible mixture into the upstream part 30*a* of this chamber and for the delivery of the combustible mixture from the downstream part 30*b* of said chamber into the corresponding annular combustion chamber 12, after transfer from the upstream part 30*a* to the downstream part 30*b*.

Obviously, since the pistons 2 and 3 form a monolithic piston block 1, the withdrawal of an annular piston 2 or 3 towards its BDC corresponds to the compression of a fresh volume of combustible mixture by the opposite annular piston 3 or 2 which simultaneously moves forward towards its TDC.

When an annular piston 2 or 3 reaches its TDC, the corresponding sparking plugs cause the ignition of the combustible mixture contained in the corresponding annular combustion chamber 12, and the explosion drives this piston towards its BDC, whilst moving the opposite piston towards its TDC and producing a fresh cycle.

The admission pumps thus constructed are therefore subjected to the same reciprocating axial movements as the pistons, which are the driving elements for the pumps and drive the latter, but which can deliver their motive power only by reason of the supply with combustible mixture effected by said pumps.

Each outer crown 9, forming the piston head proper, of the corresponding piston 2 or 3, comprises inner and outer segments 34 which permit good fluidtightness against the inner and opposite cylindrical faces of the outer 15 and inner 13 radial walls delimiting the annular combustion chamber 12.

The four pairs of radial pawls 22 convert the translational movement of the piston block 1 into a rotational movement of the driving shaft 8, due to the fact that any axial movement of the piston block 1 drives the pawls 22 in a translational movement of the same amplitude, and said pawls 22 roll by their inner radial ends in the undulated grooves 22 of the shaft 8, producing a rotational movement of the latter.

In FIG. 2, the axial spacing of the two holes 18 of a pair of holes in a particular angular position to the circumference of the central element 1*a*, corresponds to the spacing of the two undulated grooves 20 of the central part 19 of the shaft 8 illustrated in FIG. 4, and the height or amplitude of an undulation is substantially equal to the axial stroke of the piston 1. Moreover, the radial pawls 22 can rotate on themselves in the holes 18 of the piston block 1 through the intermediary of needle bearings 33 fitted in each of said holes 18, as illustrated in FIGS. 5 and 6.

In a variant of the engine according to the invention, the movement conversion mechanism is inverted, to the extent that radial pawls are housed and retained in the enlarged central part 19 of the driving shaft 8, so that one at least of their ends, in the outer radial position, is engaged and can roll in one of the sinusoidal grooves made in the cylindrical face in the inner radial position on the annular piston block 1, and in particular on its central element 1*a*.

In such an engine, it will furthermore be noticed that each of the plates 6 is necessary to effect the admission of comburent gas and/or fuel into the annular combustion chambers 12, and also for the assembly and guidance of the rotary shaft 8. On the other hand, these plates 6 are not provided with orifices to receive the sparking plugs unless the engine is of the controlled ignition type. If this engine is a diesel engine, there is no need to make holes in the plates 6 and the ends 5*a* of the cylinders 5 to house sparking plugs.

The internal-combustion engine according to the invention finds its application more particularly for the equipment of aircraft and other types of flying machines, by reason of the facility which it presents for adapting the speed of rotation of the shaft to the type of application, but, of course, such an engine may be utilised to equip marine craft or land vehicles.

The reference numerals inserted after the technical characteristics mentioned in the claims, have the sole purpose of facilitating understanding of the latter, and do not in any way limit their scope.

I claim:

1. Internal-combustion engine, comprising at least one driving shaft (8), driven in rotation by at least one engine assembly which the shaft penetrates coaxially (AA) (8), and which comprises a cylindrical housing (4), each axial end of which is integral with one of two hollow and annular cylinders (5), open towards each other and each closed by a base (5*a*) on the opposite side, and two annular pistons (2,3) guided in axial translation in the housing (4) in which they are fitted opposed, so that each of them exhibits a piston head (9) engaged to slide fluid-tightly in axial reciprocation each in one of the two annular cylinders (5), in each of which an annular combustion chamber (12) is delimited between the corresponding cylinder base (5*a*) and the piston head (9), each combustion chamber (12) being supplied by an admission system (10, 30, 29, 28, 25) for a comburent gas and/or a fuel and being in communication, through an exterior radial wall (15) of the corresponding annular cylinder (5), with a combustion gas exhaust system (16, 31, 32), the two pistons (2, 3), the housing (4), the two cylinders (5) and the shaft (8) being fitted coaxially about the longitudinal axis (AA) of the shaft (8) and the reciprocating axial movements of the pistons (2, 3) being converted into rotation of the shaft (8) about its axis (A) by a movement conversion mechanism coupling the pistons (2, 3) to a central part (19) of the shaft (8), and comprising pawls (22), one end of each of which is compelled to follow endless undulations, circumferential (20) about the axis (AA) and of the same axial amplitude, which are exhibited by a rigid member, wherein the two pistons (2, 3) are mutually integral by their bases and form a monolithic piston block (1), a central element (1*a*) of which slides in the housing (4) so that the two pistons (2, 3) move simultaneously in the axial direction and alternately in each sense, and in that the pawls (22) of the movement conversion mechanism are radial pawls, retained in one of the two rigid members formed by the central part (19) of the shaft (8) and by the central element (1*a*) of the piston block (1), whereas the undulations (20) are defined by at least one groove made in an axial surface of the other rigid member, and in which or in each of which, one end of each radial pawl (22) is engaged, the piston block (1) comprises, at each of its axial ends, an axial double skirt (2*a*, 3*a*) comprising two annular crowns (9, 10) coaxial about the axis (AA) of the shaft (8) and mutually spaced radially, and one of which (9), in the outer radial position, forms said head of the corresponding annular piston (2, 3), sliding in the corresponding annular cylinder (5) and comprising outer and inner radial segments (34), sliding against the outer (15) and inner (13) walls respectively of said annular cylinder (15), whereas the annular crown in the inner radial position (10) on the double skirt guides the piston block (1) in its axial movements by sliding within the inner wall (13) of said annular cylinder, the inner annular crown (10) of each double skirt of the piston (1) is hollow and comprises a flat and radial ring (10) which is spaced axially from the central element (1*a*) of the piston block (1) to which it is attached by at least one substantially axial and rigid column (10*a*) and which slides axially fluid tightly in an annular ante-chamber (30) delimited between the inner wall (13) of the corresponding annular cylinder (5) and a coaxial sleeve (35), surrounding the shaft (8) and fixed relative to said cylinder (5), the flat ring (10) of each inner crown is provided with axial apertures (11*a*) distributed regularly over its surface and associated with valves (11), so that the inner crown, with the antechamber (30), forms an admission pump for comburent gas and/or fuel into the corresponding combustion chamber (12), and in which the valves (11) are intended, on the one hand, to open the passage through the apertures (11*a*) into the interior of this inner crown, when the latter moves with the head (9) of the corresponding piston (2, 3) towards the base (5*a*) of the corresponding cylinder (5), to admit into this hollow inner crown (10) comburent gas and/or fuel available in the antechamber (30), and, on the other hand, to close the apertures (11*a*) when this inner crown (10) moves with the corresponding piston head (9) towards the other cylinder (5), in order to deliver comburent gas and/or fuel into said combustion chamber (12) through orifices (14) provided in the inner wall (13) of the corresponding cylinder (5).

2. An engine as claimed in claim 1, wherein a circular plate (6), coaxial with the housing (4), with the piston block (1) and with the cylinders (5), is fixed against the base (5*a*) of each cylinder (5) and exhibits a central aperture (7) fitted with a passage and rotational guide bearing for the shaft (8).

3. An engine as claimed in claim 2, wherein the admission system for comburent gas and/or fuel comprises an admission pipe (25), extending parallel to the housing (4) and outside the latter, terminating at each of the two axial ends of the engine assembly into a substantially radial conduit (25*a*) which is connected to an annular tube (27) provided with axial apertures opposite axial orifices (28) made in the plate (6) on the corresponding side, in which independent and compensated valves (29) to supply said antechamber (30) with comburent gas and/or fuel are fitted.

4. An engine as claimed in claim 2, of the controlled ignition type, wherein the plates (6) and the bases (5*a*) of the cylinders (5) are provided with opposite axial passages (24), leading into the annular combustion chambers (12) and in which sparking plugs are fitted.

5. An engine as claimed in claim 3, wherein the longitudinal axis of each admission valve (29) coincides with the longitudinal axis of one of the apertures (11*a*) made in the flat ring (10) of the inner crown sliding in the corresponding antechamber (30).

6. An engine as claimed in claim 1, wherein said central part (19) of the shaft (8) is an enlarged cylindrical part, of greater diameter than the adjacent axial parts of the shaft which are housed in the engine assembly, and in the lateral cylindrical surface of which each undulated groove (20) is made, in which move the inner radial ends of the pawls (22) radially penetrating said central element (1*a*), which is tubular and slides axially about said central part (19) of the shaft (8), each groove (20) forming regular undulations, the number of which is a function of the required speed of rotation of the shaft (8).

7. An engine as claimed in claim 6, wherein the central element (1*a*) of the annular piston block (1) is penetrated in its median part by radial guide holes (18) for the pawls (22), said holes (18) being grouped in at least two identical sets of at least two holes (18) each, the different sets of holes (18) being mutually equidistant in the circumferential direction, and the holes of each set being mutually parallel and staggered axially in one and the same radial plane, whereas the enlarged central part (19) of the shaft (8) exhibits undulated grooves (20) in equal phase and number to the number of holes (18) per set of holes, and axially staggered correspondingly to the axial staggering of the holes (18) of each set of holes.

8. An engine as claimed in claim 7, wherein the housing (4) exhibits axial ports, (21) leading into its cylindrical bore, and each placed radially opposite a set of holes (18) of the piston block (1), the pawls (22) housed in the holes (18) of said set each having its exterior radial end engaged in the corresponding port (21), which guides them axially with the piston block (1) in the housing (4).

9. An engine as claimed in claim 8, wherein the inner radial end of each of the pawls (22) penetrating one and the same set of holes (18) in the piston block (1) is kept engaged in said undulated groove (20) of the central part (19) of the shaft (8) by a cage, (23) fixed on the exterior face of the housing (4), about the corresponding port (21), and equipped with bearings ensuring good circulation of the outer radial ends of said pawls (22) in said corresponding port (21).

10. An engine as claimed in claim 4, wherein each radial pawl (22) is divided, substantially at mid-length, into two parts (22*a*, 22*b*) arranged end to end and such that an inner radial end of the inner radial part (22*a*) and an outer radial end of the outer radial part (22*b*) are engaged and can rotate mutually independently, and optionally in opposite senses, in the corresponding groove (20) of the shaft (8) and of the corresponding port (21) of the housing (4) respectively.

11. An engine as claimed in claim 9, wherein the enlarged central part (19) of the shaft (8) exhibits two undulated grooves (20), and the central element (1*a*) of the piston block (1) is provided with four sets of two radial holes (18) housing eight pawls (22) guided axially in four ports (21) of the housing (4) which are closed towards the outside by four cages (23).

* * * * *